United States Patent [19]

Bakx

[11] Patent Number: 4,932,531

[45] Date of Patent: Jun. 12, 1990

[54] MULTIPACK FOR A TWO TIER GROUP OF CONTAINERS

[75] Inventor: Martinus C. M. Bakx, Roosendaal, Netherlands

[73] Assignee: The Mead Corporation, Dayton, Ohio

[21] Appl. No.: 332,659

[22] Filed: Apr. 3, 1989

[30] Foreign Application Priority Data

Apr. 5, 1988 [GB] United Kingdom ..... 8807897

[51] Int. Cl.[5] ..... B65D 5/02; B65D 65/12; B65D 75/28

[52] U.S. Cl. ..... 206/499; 206/434; 229/40

[58] Field of Search ..... 206/427, 430, 434, 499, 206/139, 140, 485; 229/40

[56] References Cited

U.S. PATENT DOCUMENTS

| | | | |
|---|---|---|---|
| 2,874,869 | 2/1959 | Hennessey | 206/430 |
| 4,416,411 | 11/1983 | Desmond et al. | 229/40 |
| 4,756,419 | 7/1988 | Le Bras | 229/40 |

*Primary Examiner*—Paul T. Sewell
*Assistant Examiner*—Jacob K. Ackun, Jr.
*Attorney, Agent, or Firm*—Erwin Doerr

[57] ABSTRACT

A package accommodating a group of containers arranged in two tiers has an upper tier and a lower tier each comprising a plurality of like containers. The package includes an outer wrapper (10) which secures all the containers of the group together in a unit and a partition (30) provided between the bases of the containers in the upper tier and the tops of the containers in the lower tier. The partition includes end retention panels (58, 60) adapted to prevent endwise dislodgement of the containers in the upper tier.

4 Claims, 2 Drawing Sheets

MULTIPACK FOR A TWO TIER GROUP OF CONTAINERS

This invention relates to a package accommodating a group of containers arranged in two tiers in which both an upper and a lower tier comprises a plurality of like containers arranged in a row.

The package includes a wrapper which secures all the containers of the group together in a unit and a partition between the two tiers which protects the tops of the containers in the lower tier and provides end retention means for assisting in the prevention of end-wise dislodgement of the containers in the upper tier.

The invention provides a package accommodating a group of containers arranged in two tiers in which both an upper tier and a lower tier each comprise a plurality of like containers, the package including an outer wrapper which secures all the containers of the group together in a unit and a partition provided between the bases of the containers in the upper tiers and the tops of the containers in the lower tier, characterised in that the partition includes end retention means adapted to prevent endwise dislodgement of the containers in the upper tier.

According to a feature of the invention, the end retention means may comprise portions of the partition at each end thereof which are displaced upwardly out of the plane of that central part of the partition which overlies the tops of the containers in the lower tier between said end portions. Preferably, the end retention means comprises strips of the partition which can be displaced away from said central part by virtue of a cut line present in the partition between each strip and said central part and by virtue of a central foldline extending across each strip.

The partition may include a pair of side panels each of which is hinged to side edges of the said central part of the partition and to each of said end retention strips. Where side panels are provided, the distance between the fold lines by which opposite sides of each retention strip is hinged to the side panels may be greater than the distance between the fold lines by which opposite sides of said central part is hinged to the side panels whereby said retention strip can be displaced upwardly out of the plane of said central part without distorting said side panels.

Preferably, the fold lines by which opposite sides of said central part is hinged to the side panels include slits to receive peripheral wall portions of the containers in said lower tier.

Figure 1:
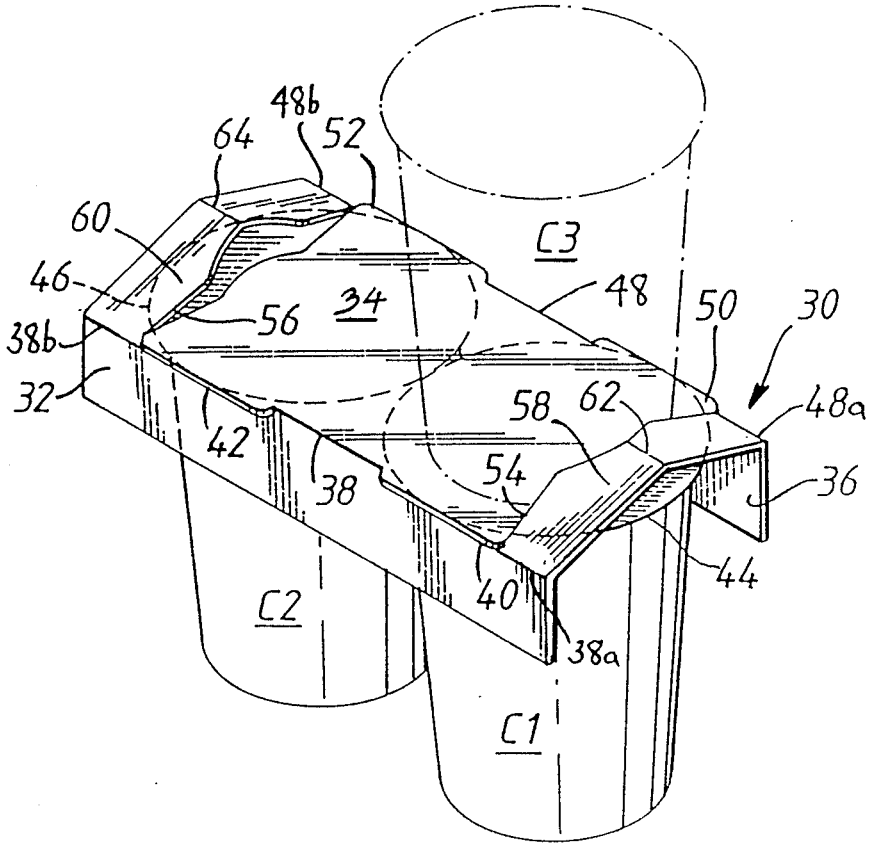
Figure 2:
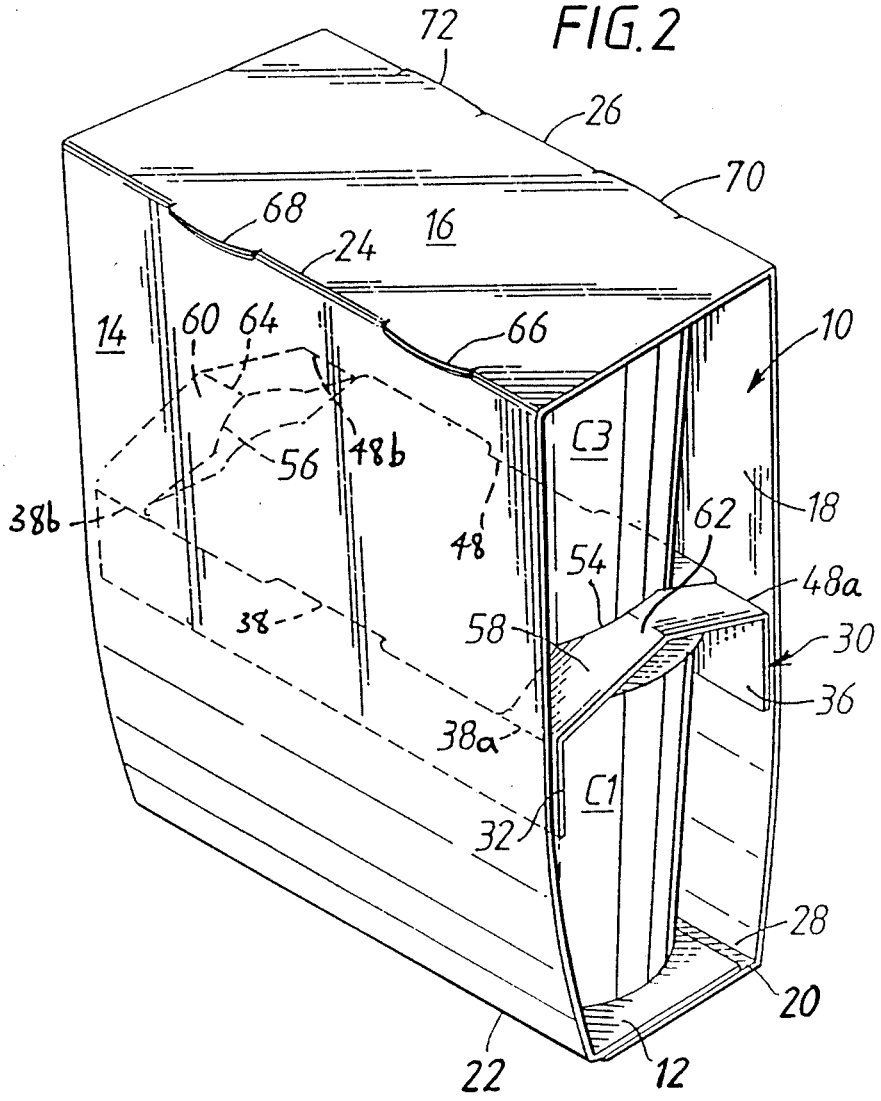

An embodiment of the invention will now be described, by way of example, with reference to the accompanying drawings, in which:

FIG. 1 is a perspective view of a pair of containers to the lids of which the partition blank has been applied; and FIG. 2 is a perspective view of the completed package according to the invention.

Referring first to FIGS. 1 and 2 of the drawings, the wrapper 10 is formed from a single sheet of paperboard or similar foldable sheet material and comprises, in series, a first base panel 12, a first side wall panel 14, a top panel 16, a second side wall panel 18 and a second base panel 20 hinged one to the next along transverse fold lines 22, 24, 26 and 28 respectively.

As is well known in the art, in order to maintain the wrapper blank wrapped around the packaged articles, locking elements (not shown) may be provided to lock together the base panels. In this regard, base panel 12 is formed with hinged retaining tabs which define locking apertures at spaced locations therealong and cooperating locking tabs are struck from the base panel 20. The locking tabs are inserted into the locking apertures in known manner to lock the base panels together in overlapping relationship.

The partition blank 30 is formed from a single sheet of paperboard or similar foldable sheet material and comprises a first side panel 32, a divider panel 34 and a second side panel 36. First side panel 32 is hinged to one edge of the divider panel 34 along fold lines 38, 38*a* and 38*b* spaced apart by slots 40 and 42 which receive peripheral portions of top flanges 44 and 46 respectively of cups C1 and C2. Likewise, second side wall panel 36 is hinged to the opposite edge of the divider panel along fold lines 48, 48*a* and 48*b* spaced apart by slots 50 and 52 which receive diametrically opposed peripheral portions of flanges 44 and 46, respectively.

The divider panel is formed with transverse cuts 54 and 56 adjacent each of its ends to form end retention strips 58 and 60 each of which has a central longitudinal fold line 62 and 64 so that the retention strips can be displaced upwardly out of the plane of the blank as shown in FIG. 1. Upward displacement of the end retention strips 58 and 60 is made possible because the distance between fold lines 38*a* and 48*a*; 38*b* and 48*b* is greater than the distance between fold lines 38 and 48 whereby the end retention strips can be displaced without distorting side panels 32 and 36.

In order to form the two tier package shown in FIG. 2 first the partition blank 30 is laid onto the lower pair of cups C1 and C2 and the first and second side wall panels 32 and 36 folded downwardly so that they flank portions of the cup bodies and the retaining slots 40, 42; 50, 52 register with flanges 44 and 46. The side wall panels facilitate correct positioning of the partition relative to the cups. The end retention strips 58 and 60 are then erected by displacing them about fold lines 62 and 64 upwardly out of the plane of the partition blank 30. A pair of upper tier cups C3 and C4 are seated on the divider plane 34 so that their bases overlie the lids of respective ones of the cups C1 and C2 in the lower tier. The lines of cut 54 and 56 are shaped so that the edge of each retention strip engaging a cup C3, C4 is shaped to follow the contour of the cups' side wall portion in abutment with the strip edge.

The wrapper blank 10 is then applied to the two-tier stack of cups which are separated by the partition, in known manner, so that the top panel 16 overlies the tops of the cups C3 and C4 in the upper tier and the base panels are secured together beneath lower cups C1 and C2 in the lower tier.

During application of the wrapper blank retaining slits 66, 68 and 70, 72 which are struck from the blank along fold lines 24 and 26 respectively engage flange portions of the cups C3 and C4 in order to assist in the retention of the cups from endwise dislodgement from the package. Of course, this function is also provided by the erected end retention strips which prevent heel portions of the upper tier cups C3 and C4 from being dislodged endwise from the package.

I claim:

1. A package accommodating a group of containers (C1–C4) arranged in two tiers in which both an upper tier and a lower tier each comprise a plurality of like containers, the package including an outer wrapper (10)

which secures all the containers of the group together in a unit and a partition (30) provided between the bases of the containers in the upper tier (C3, C4) and the tops of the containers (C1, C2,) in the lower tier, said partitions comprising a central part which overlies the tops of the containers in the lower tier, a pair of side panels (32, 36) extending downwardly along the sides of the containers, and end retention means (60, 62) formed from portions of said central part at each end thereof, said end retention means (60, 62) being defined by cuts (54, 56) spaced inwardly from the end edges of said central part and extending transversely thereof, said end retention means being displaced upwardly out of the plane of said central part so as to prevent endwise dislodgment of the containers in the upper tier, said side panels being hinged to the side edges of said central part and to said end retention means along fold lines (38*b*, 38, 38*a*; 48*b*, 48, 48*a*) arranged so that the distance between the fold lines (38*b*, 48*b*; 38*a*, 48*a*) by which each end retention means is hinged to the side panels is greater than the distance between the fold lines (38, 48) by which said central part is hinged to said side panels whereby said end retention means are being displaced upwardly out of the plane of said central part when said side panels are folded downwardly.

2. A package according to claim 1, wherein said end retention means are displaced upwardly along central longitudinal fold lines (62, 64).

3. A package according to claim 1, wherein said transverse cuts (54, 56) are configured to conform to the side walls of the adjacent containers.

4. A package according to claim 1, wherein the fold lines (38, 48) by which opposite ends of said central part is hinged to the side walls include slits (40, 42; 50, 52) to receive peripheral wall portions of the containers in said lower tier.

* * * * *